US006579415B2

(12) United States Patent
Jewell

(10) Patent No.: US 6,579,415 B2
(45) Date of Patent: Jun. 17, 2003

(54) METHOD OF INCREASING THE WET STRENGTH OF A FIBROUS SHEET

(75) Inventor: Richard A. Jewell, Bellevue, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/260,876

(22) Filed: Sep. 27, 2002

(65) Prior Publication Data

US 2003/0029586 A1 Feb. 13, 2003

Related U.S. Application Data

(62) Division of application No. 09/222,372, filed on Dec. 29, 1998, now Pat. No. 6,471,824.

(51) Int. Cl.[7] ..... D21C 9/00; D06M 13/192; D21H 11/20

(52) U.S. Cl. ..... 162/157.6; 162/9; 162/146; 162/182; 162/158; 8/116.1; 8/120

(58) Field of Search ..... 162/157.6, 157.1, 162/146, 141, 158, 164.3, 164.6, 168.2, 175, 169, 9, 182; 8/115.51–115.56, 116.1, 181, 119, 120, 129

(56) References Cited

U.S. PATENT DOCUMENTS

| | | | | | |
|---|---|---|---|---|---|
| 5,137,537 | A | * | 8/1992 | Herron et al. | 8/120 |
| 5,183,707 | A | | 2/1993 | Herron et al. | |
| 5,190,563 | A | * | 3/1993 | Herron et al. | 8/120 |
| 5,549,791 | A | | 8/1996 | Herron et al. | |
| 5,562,740 | A | * | 10/1996 | Cook et al. | 8/120 |
| 5,667,637 | A | * | 9/1997 | Jewell et al. | 162/146 |
| 5,755,828 | A | * | 5/1998 | Westland | 8/185 |
| 5,770,711 | A | | 6/1998 | Greene et al. | |
| 5,873,979 | A | * | 2/1999 | Naieni | 162/157.6 |
| 5,958,180 | A | * | 9/1999 | Hubbe et al. | 162/9 |
| 6,361,651 | B1 | * | 3/2002 | Sun | 162/158 |

* cited by examiner

*Primary Examiner*—Jose A. Fortuna
(74) *Attorney, Agent, or Firm*—Christensen O'Connor Johnson Kindness PLLC

(57) ABSTRACT

Carboxylated cellulosic fibers are disclosed. The fibers include a polycarboxylic acid covalently coupled to the fibers. Methods for producing the fibers and for producing fibrous products that incorporate the fibers are also disclosed.

5 Claims, 5 Drawing Sheets

METHOD OF INCREASING THE WET STRENGTH OF A FIBROUS SHEET

CROSS REFERENCE TO RELATED APPLICATION

This application is a divisional application of copending U.S. patent application Ser. No. 09/222,372 filed Dec. 29, 1998 now U.S. Pat. No. 6,471.824 B1, the benefit of the priority of the filing date of which is hereby claimed under 35 USC §120. U.S. patent application Ser. No. 09/222,372 is incorporated herein by reference in its entirety.

FIELD OF THE INVENTION

The present invention is generally directed to cellulosic fibers and, more particularly, to carboxylated cellulosic fibers and methods for their formation and use.

BACKGROUND OF THE INVENTION

The tensile or sheet strength of fibrous products derived from cellulose fibers is due in large part to attractive fiber-to-fiber interactions. These interfiber interactions include hydrogen bonding interactions between fibers having hydrogen bonding sites. For cellulose, hydrogen bonding sites primarily include the hydroxy groups of the individual cellulose chains.

The present invention relates to increasing the strength of cellulosic fiber sheets by incorporating carboxyl groups into cellulosic fibers from which the sheets are made. In accordance with the present invention, carboxyl groups are incorporated into cellulosic fibers through reaction with a carboxylating agent that is a polycarboxylic acid.

Treating cellulosic fibers with polycarboxylic acids is known in the art. For example, polycarboxylic acids have been used as crosslinking agents for cellulose. Cellulose has been modified by reaction with dicarboxylic acids and their derivatives to form simple diester crosslinks. Phthalic, maleic, and succinic anhydrides have been used to form diester crosslinks in cellulose. Cotton has been treated with dicarboxylic acid chlorides having varying chain lengths (e.g., from succinyl to sebacoyl) to provide ester crosslinks. Dicarboxylic acids have also been reacted with cellulose to provide crosslinked cellulose containing diester crosslinks of various lengths (e.g., $C_3$–$C_{22}$). However, oxalic acid has been shown to be unreactive to cellulose crosslinking, and succinic and glutaric acids have been shown to have only slight reactivity. For a review of ester crosslinked cellulosic fibers, see Tersoro and Willard, Cellulose and Cellulose Derivatives, Bikales and Segal, eds., Part V, Wiley-InterScience, New York, 1971, pp. 835–875.

Polycarboxylic acid crosslinked fibers and their preparation and use are also described in U.S. Pat. Nos. 5,137,537; 5,183,707; and 5,190,563, issued to Herron et al. The Herron patents generally describe the preparation and use of individualized, polycarboxylic acid crosslinked cellulosic fibers having advantageous reduced water retention value properties. These fibers have a $C_2$–$C_9$ polycarboxylic acid crosslinking agent reacted with the fibers in the form of an intrafiber crosslink bond. The cellulosic fibers treated with the polycarboxylic acid crosslinking agents are cured at elevated temperature (e.g., about 190° C.) to exhaustively couple the polycarboxylic acid to the cellulosic fibers through ester crosslinks. The $C_2$–$C_9$ polycarboxylic acid crosslinking agents include citric acid, 1,2,3-propanetricarboxylic acid, 1,2,3,4-butanetetracarboxylic acid, and oxydisuccinic acid, among others.

Polymeric polycarboxylic acids have also been used to crosslink cellulosic fibers. The use of polyacrylic acid crosslinking agents, including copolymers of acrylic acid and maleic acid, is described in U.S. Pat. No. 5,549,791, issued to Herron et al. These polycarboxylic acid crosslinking agents were found to be particularly suitable for forming ester crosslink bonds with cellulosic fibers. Unlike some conventional crosslinking agents (e.g., $C_2$–$C_9$ polycarboxylic acids such as citric acid) that are temperature sensitive, polyacrylic acid is stable at high temperature and, therefore, can be subjected to elevated cure temperatures to effectively and efficiently provide highly crosslinked fibers. The Herron patent describes curing polyacrylic acid treated cellulosic fibers at about 190° C. for about 30 minutes to form interfiber ester crosslinked bonds.

The mechanism of crosslinking paper with polycarboxylic acids has been described. See, Zhou et al., *Journal of Applied Polymer Science,* Vol. 58, 1523–1534 (1995). Brief thermocuring of paper treated with aqueous solutions of polycarboxylic acids provided paper having excellent wet strength through crosslinking. The effectiveness of a polycarboxylic acid to impart wet strength to paper was found to increase with increasing polycarboxylic acid functionality (i.e., number of carboxyl groups). Butanetetracarboxylic acid (BTCA) was found to be more effective than tricarballylic acid (TCA), which in turn was found to be significantly more effective than succinic acid (a dicarboxylic acid). The excellent wet strengthening properties of polycarboxylic acids such as BTCA and TCA were determined to reflect the acids' ability to form multiple, reactive anhydrides during the curing reaction either directly, in the form of a dianhydride for BTCA, or in a successive, stepwise mode for BTCA and TCA. For succinic acid, such a consecutive reaction is more difficult and reaction with succinic acid leads to a substituted cellulose having a considerable proportion of single carboxylic acid groups attached to cellulose through an ester link. Because the residual single carboxyl group reacts with cellulosic hydroxyl groups at a slower rate, succinic acid has been shown to be a poor crosslinking and wet strength agent for paper. See Zhou et al.

The mechanism of polycarboxylic acid crosslinking of papers has been shown to occur in four stages: (1) formation of 5- or 6-membered anhydride ring from polycarboxylic acid; (2) reaction of the anhydride with a cellulose hydroxyl group to form an ester and link the polycarbide acid to cellulose; (3) formation of additional 5- or 6-membered ring anhydride from polycarboxylic acids' pendant carboxyl groups; and (4) reaction of the anhydride with other cellulose hydroxyl groups to form ester crosslinks.

Reaction of paper with succinic acid at 150° C. results in the formation of ester bonds or links, the number of which increases with curing time. A small amount of crosslinking is observed, and the amount of crosslinking increases significantly with curing time and higher curing temperatures.

While polycarboxylic acid reaction with cellulose leads to substitution and crosslinking, only interfiber ester covalent bonds can support paper structure when wet. Because the ester links are water stable, the crosslinks prevent swelling of fibers and thus may help hold the paper's fibers together. Although the introduction of carboxy groups into paper through esterification may affect some aspects of the paper's characteristics, the paper's primary wet strength results from the formation of interfiber ester covalent bonds. Both crosslinking and formation of interfiber ester covalent bonds are essentially the same chemical reaction. It can be seen that the critical factors are whether the fibers are in contact with one another during curing and the ability of the polycarboxylic acid to undergo more than one esterification reaction with cellulose hydroxyl groups.

Although the number of carboxyl groups incorporated into a paper treated with succinic acid can be high, the resulting paper has little wet strength. Because these pendant carboxyl groups are largely incapable of further reaction with cellulose's hydroxyl groups to provide interfiber bonds or crosslinked fibers under normal curing conditions, most of these pendant carboxyl groups remain free. The mere presence of carboxylic acid moieties in a paper's cellulosic fibers does not impart wet strength to the paper.

However, cellulosic fibers modified to include carboxyl groups have been shown to impart strength to sheets in which the fibers are incorporated. More specifically, fibrous sheets incorporating carboxymethylated cellulose and carboxyethylated cellulose have been found to be relatively easily fibrilated or repulped and formed into sheets having superior strength properties. See U.S. Pat. No. 5,667,637, issued to Jewell et al., and references cited therein.

The wet strength of fibrous sheets made from carboxymethylated and carboxyethylated cellulose can be further increased by blending the carboxylated fibers with a wet strength resin, particularly a cationic additive. See, for example, U.S. Pat. No. 5,667,637, and references cited therein. Generally, the addition of carboxyl groups to cellulose is believed to enhance the efficiency of the wet strength resin by imparting wet strength to fibrous sheets containing such fibers. The combination of carboxyethylated fibers and cationic additive materials has been found to be unexpectedly advantageous with regard to wet strength compared to combinations of carboxymethylated fibers and similar cationic additive materials. See U.S. Pat. No. 5,667,637.

Despite the advances in the use of carboxylated fibers and the formation of fibrous webs incorporating such fibers, there exists a need for carboxylated fibers that do not suffer the drawbacks of carboxymethylated and carboxyethylated cellulosic fibers, which include high cost and lost hemicelluloses. Accordingly, there is a need in the art for modified cellulosic fibers having advantageous absorbent properties and, in addition, having enhanced bondability so as to increase the strength of products that incorporate these fibers. The present invention seeks to fulfill these needs and offers further related advantages.

SUMMARY OF THE INVENTION

In one aspect, the present invention provides carboxylated cellulosic fibers. Fibrous sheets and absorbent products containing carboxylated cellulosic fibers are also disclosed. The fibrous sheets generally include carboxylated fibers, a cationic additive, and, optionally, other fibers.

In another aspect of the invention, a method for producing carboxylated cellulosic fibers is provided. The method produces carboxylated cellulosic fibers by applying a carboxylating agent to the fibers and then heating the treated fibers for a period of time under controlled temperature, time, pH, and catalyst concentration conditions to effect bond formation between the carboxylating agent and the fiber while minimizing crosslinking reactions. The carboxylating agent is any chemical compound having two carboxylic acid groups separated by either two or three atoms such that the compound can form a cyclic 5- or 6-membered anhydride. Suitable carboxylating agents include succinic acid and succinic acid derivatives, phthalic acid, trimellitic acid, maleic acid, and itaconic acid and their derivatives. Bond formation between the carboxylating agent and the fiber is preferably the formation of a single ester bond between the carboxylating agent and the fiber and not the formation of extensive fiber crosslinks.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
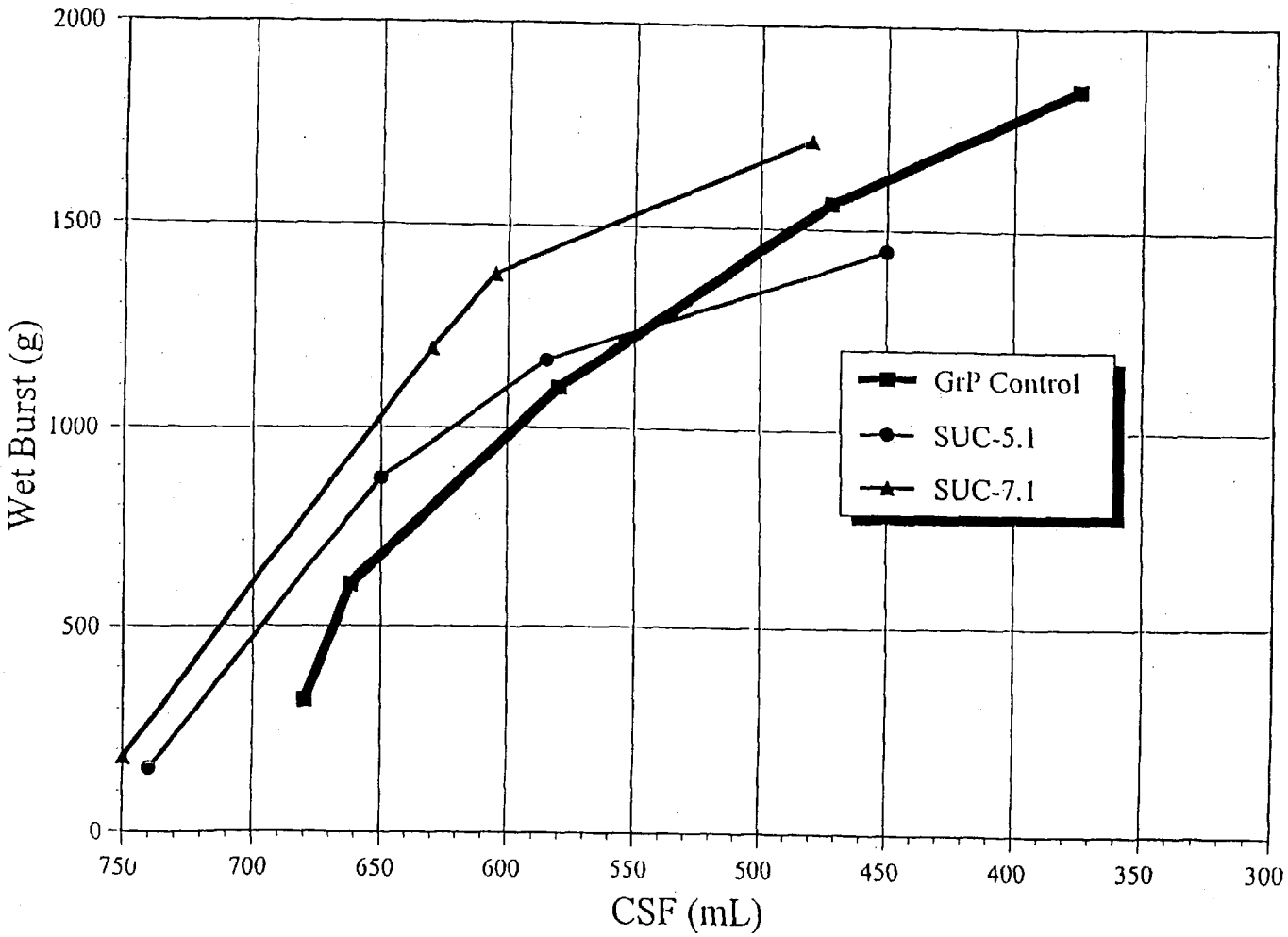
FIG. 1 is a graph showing wet burst strength of handsheets prepared from refined soft wood pulp (various Canadian Standard Freeness, CSF) modified with succinic acid (SUC) and 2 percent Kymene® 557H; GrP control refers to a handsheet prepared from unmodified fibers; SUC-5.1 and SUC-7.1 refer to handsheets prepared from succinic acid-modified fibers having 5.1 and 7.1 milliequivalents (meq) carboxyl groups/100 g fiber, respectively.

The present invention is directed to cellulosic fibers having enhanced bondability and methods related to such fibers. More specifically, the invention relates to carboxylated cellulosic fibers, products containing these cellulosic fibers, and methods for producing and using these fibers. The carboxylated cellulosic fibers of the invention exhibit high absorbent capacity and bulk, and when such fibers are formed into a sheet and/or incorporated into an absorbent product, the resulting sheet or absorbent product exhibits increased wet strength in the presence of a cationic wet strength additive. The carboxylated cellulosic fibers of the invention can also be advantageously combined with other fibers to provide a fibrous mixture having increased sheet strength.

In one aspect, the present invention provides a carboxylated cellulosic fiber having enhanced bondability and absorbent capacity. As used herein, the term "carboxylated cellulosic fiber" refers to a cellulosic fiber that has been modified to include carboxylic acid groups (i.e., carboxyl groups) by chemical reaction with a carboxylating agent.

The carboxylating agent useful in forming the carboxylated cellulosic fiber of the invention is a chemical compound having two carboxylic acid groups separated by either two or three atoms such that the compound can form a cyclic 5- or 6-membered anhydride ring. Generally, the carboxylating agent is a polycarboxylic acid. As used herein, the term "polycarboxylic acid" refers to an organic acid that contains two or more carboxylic acid groups, or the functional equivalent of two or more carboxylic acid groups, for example, acid salt, ester, and anhydride groups, among others. The carboxylated fiber includes a polycarboxylic acid covalently coupled or bonded to the cellulose fiber. The polycarboxylic acid is coupled to the fiber through the formation of an ester bond between a carboxylic acid group on the polycarboxylic acid and a hydroxyl group on the cellulosic fiber. Coupling the polycarboxylic acid to the fiber in this way provides a fiber into which a carboxylic acid group has been incorporated. Where the carboxylating agent is a polycarboxylic acid having two carboxylic groups (i.e., a dicarboxylic acid), the modified fiber preferably includes one carboxyl group for each carboxylating agent reacted with and coupled to the fiber (i.e., the carboxylating agent provides one carboxyl equivalent to the fiber). For carboxylating agents that are polycarboxylic acids that contain three or more carboxylic acid groups, the modified fiber preferably includes more than one carboxyl group for each carboxylating agent coupled to the fiber.

The carboxylated fibers of the present invention can vary with regard to the extent of incorporated carboxyl groups. Generally, sufficient carboxyl groups are incorporated into the fibers to provide an improvement in wet strength when combined with wet strength additives, absorbent capacity, or other advantageous property compared to unmodified fibers. Depending on the nature of the subsequent use of a particular carboxylated fiber, the carboxylated fibers have from about 5 to about 50 milliequivalent (meq) carboxyl groups per 100 grams fiber. In a preferred embodiment, the carboxylated fibers have from about 6 to about 40 meq carboxyl groups per 100 grams fiber.

As noted above, the carboxylated fibers of this invention are produced by treating cellulosic fibers with a carboxylating agent, and optionally a catalyst, for a period of time and at a temperature sufficient to form an ester bond between the polycarboxylic acid and the fiber. In contrast to "curing", which refers to the exhaustive reaction of an agent (e.g., a crosslinking agent) with fibers, the bonding of the polycarboxylic acid to the fibers in accordance with the present invention refers to less than exhaustive reaction of the polycarboxylic acid's carboxyl groups with the fiber. For example, for many crosslinking agents, including polycarboxylic acid crosslinking agents, exhaustive reaction between the fiber and substantially all of the crosslinking agent's carboxylic acid groups is desired and accomplished by either prolonged reaction time and/or elevated cure temperature. Polycarboxylic acid "covalent coupling" or "bonding" to the fibers in accordance with the present invention refers to a controlled, nonexhaustive reaction, for example, the coupling of less than all carboxyl groups, and more preferably only a single carboxyl group, of the polycarboxylic acid to a fiber. An important aspect of the present invention is the discovery of a method to accomplish coupling while minimizing or eliminating crosslinking. Crosslinking reduces the interfiber bonding of fibers by reducing the swelling and water retention value (WRV) of wet fibers. Reduction of these properties results in reduced bonded area between fibers. Thus, a preferred embodiment of this invention includes conducting the coupling reaction such that the carboxylated fibers have a WRV equal to that of the starting fibers, and preferably greater than that of the starting fibers.

Generally, the carboxylating agent useful in forming the carboxylated fibers of the invention is an organic acid containing two or more carboxyl groups having either a 1,2- or a 1,3-diacid substitution. That is, the carboxylating agent contains at least two carboxylic acid groups with one carboxyl group separated from the second carboxyl group by either two (i.e., 1,2-diacid) or three (i.e., 1,3-diacid) atoms. Without being bound by theory, it appears that a carboxyl group is most reactive toward bonding with cellulose when the carboxylating agent can form a cyclic five- or six-membered anhydride with a neighboring carboxyl group. Thus, the carboxylating agent useful in the present invention preferably contains at least two carboxyl groups that are separated by either two or three atoms in the chain or ring to which the carboxyl groups are attached. The atoms separating the carboxyl groups can include carbon, nitrogen, sulfur, and oxygen atoms, and mixture of these atoms. Preferably, the carboxylating agent includes two carboxyl groups that are separated by carbon atoms, more preferably saturated carbon atoms (e.g., methylene and methine carbons) and carbon atoms that are further substituted (e.g., dimethyl and sulfonic acid substituted carbons).

Suitable carboxylating agents include aliphatic, unsaturated, aromatic, alicyclic and cyclic acids. For carboxylating agents having two carboxyl groups separated by a carbon-carbon double bond (e.g., unsaturated acids) or where both carboxyl groups are connected to the same ring (e.g., cycloalkyl), the two carboxyl groups must be in a cis configuration relative to each other so that the carboxylating agent can form a cyclic five- or six-membered anhydride.

In a preferred embodiment, the carboxylating agent is a dicarboxylic acid having two or three atoms separating the carboxyl groups. In one preferred embodiment, the carboxylating agent is a 1,2-dicarboxylic acid or derivative, preferably succinic acid (i.e., $HO_2CCH_2CH_2CO_2H$) or a succinic acid derivative. Preferred succinic acid derivatives include 2-sulfosuccinic acid and 2,2-dimethylsuccinic acid. In another preferred embodiment, the carboxylating agent is a 1,3-dicarboxyl acid, preferably glutaric acid (i.e., $HO_2CCH_2CH_2CH_2CO_2H$) or a glutaric acid derivative. Preferred glutaric acid derivatives include 2,2-dimethylglutaric acid and diglycolic acid (i.e., $HO_2CCH_2OCH_2CO_2H$). Other suitable dicarboxylic acids include 1,2-dicarboxybenzene (e.g., 1,2-phthalic acid) and its derivatives, 1,2- and 1,3-dicarboxycycloalkanes, trimellitic acid, maleic acid, and itaconic acid and their derivatives.

In the practice of the present invention, dicarboxylic acids having either a 1,2- or a 1,3-diacid substitution are preferred because the diacid can (1) form a cyclic five- or six-member anhydride, which is reactive toward cellulosic hydroxyl groups, and (2) provide a free carboxyl group that is relatively resistant to subsequent ester formation with a cellulosic hydroxyl group. For the reasons noted above, the free carboxyl group incorporated into the fiber by carboxylating with a 1,2- or 1,3-dicarboxylic acid, or acid derivative, is resistant to subsequent ester formation with the cellulose fiber (i.e., the dicarboxylic acid does not function as a crosslinking agent). Preferred carboxylating agents ultimately form a single ester bond with a cellulose fiber and incorporate one or more carboxyl groups for each carboxylating agent coupled to the fiber.

Polycarboxylic acids having more than two carboxyl groups have been previously utilized to effectively crosslink cellulose to provide cellulosic fibers having high bulk, resilience, and rapid liquid acquisition properties. Such crosslinked fibers suffer from low bondability by virtue of the loss of interfiber hydrogen bonding that accompanies crosslinking. Basically, crosslinking reduces the relative bonded area between fibers by reducing swelling, conformability, flexibility, and surface area of wet fibers. Crosslinking also reduces the refinability of fibers, that is, the ability to create additional surface area through mechanical refining. Thus, although sheets of crosslinked fibers have high bulk and certain advantageous absorbent properties, these sheets suffer from low dry and wet strength.

Despite the inherent disadvantages noted above associated with crosslinking cellulosic fibers with polycarboxylic acids, under certain conditions, polycarboxylic acids having three or more carboxy groups can be used in forming the carboxylated fibers of the present invention. When polycarboxylic acids are used as carboxylating agents, conditions for coupling the polycarboxylic acid to the fiber are such that exhaustive reaction (i.e., extensive crosslinking) is avoided and the polycarboxylic acid is preferably coupled to the fiber through a single ester bond and the remaining polycarboxylic acid's carboxyl groups are incorporated as free carboxyl groups to the fiber. Reaction conditions such as temperature, pH, time, fiber moisture content, crosslinking agent concentration, and catalyst concentration, among others, can be optimized to promote coupling of a polycarboxylic acid to fibers without significant crosslinking to provide carboxylated fibers having the advantageous properties noted above.

The carboxylated cellulosic fibers formed in accordance with the present invention include a polycarboxylic acid covalently coupled to a cellulose fiber through an ester bond. Although the polycarboxylic acid useful in the present invention is not a crosslinking agent, it will be appreciated that, while the formation of multiple ester bonds between a polycarboxylic acid and one or more cellulose chains or fibers is minimized, it can still occur to a limited extent and, therefore, such bonding between the polycarboxylic acid and the fibers is within the scope of this invention. For example, the polycarboxylic acid may form a single ester bond to a cellulose chain, two or more ester bonds with a chain, or two or more ester bonds between two or more chains or fibers. In any event, in accordance with the present invention, after covalent coupling to the fiber, the polycarboxylic acid has at least one free carboxylic acid group.

In addition to the dicarboxylic acids described above, other suitable carboxylating agents include polycarboxylic acids containing three or more carboxyl groups. Exemplary polycarboxylic acids include citric acid (i.e., 2-hydroxy-1,2,3-propane tricarboxylic acid), 1,2,3-propane tricarboxylic acid, 1,2,3,4-butane tetracarboxylic acid, tartrate monosuccinic acid, tartrate disuccinic acid, oxydisuccinic acid (i.e., 2,2'-oxybis(butanedioic acid)), thiodisuccinic acid, trans-1-propene-1,2,3-tricarboxylic acid, all cis-1,2,3,4-cyclopentanetetracarboxylic acid, and benzenehexacarboxylic acid.

In addition to the polycarboxylic acids described and noted above, polycarboxylic acid carboxylating agents include polymeric polycarboxylic acids. Suitable polymeric polycarboxylic acids include homopolymeric and copolymeric polycarboxylic acids and may advantageously incorporate self-catalyzing substituents in the polymer chain, such as phosphonoalkyl groups. Representative homopolymeric polycarboxylic acids include, for example, polyacrylic acid, polyitaconic acid, and polymaleic acid. Examples of representative copolymeric polycarboxylic acids include polyacrylic acid copolymers such as poly(acrylamide-co-acrylic acid), poly(acrylic acid-co-maleic acid), poly(ethylene-co-acrylic acid), and poly(1-vinylpyrrolidone-co-acrylic acid), as well as other polycarboxylic acid copolymers including poly(ethylene-co-methacrylic acid), poly(methyl methacrylate-co-methacrylic acid), poly(methyl vinyl ether-co-maleic acid), poly(styrene-co-maleic acid), and poly(vinyl chloride-co-vinyl acetate-co-maleic acid). In one preferred embodiment, the polymeric polycarboxylic acid is a polyacrylic acid. In another preferred embodiment, the polycarboxylic acid is a polyacrylic acid containing phosphonoalkyl groups (e.g., A9930 commercially available from Rohm and Haas, Co., Philadelphia, Pa.). In another preferred embodiment, the polymeric polycarboxylic acid is a polymaleic acid. In still another preferred embodiment, the polymeric polycarboxylic acid is copolymer of acrylic acid, and preferably a copolymer of acrylic acid and another acid, for example, maleic acid. The representative polycarboxylic acids noted above are available in various molecular weights and ranges of molecular weights from commercial sources.

In contrast to the polyacrylic acid crosslinking agent treatment described in Herron, in the method of the present invention the polycarboxylic acids are not subjected to elevated cure temperatures to effect exhaustive polycarboxylic acid-to-fiber crosslinking. Rather, in this invention, the polycarboxylic acid is cured at a significantly lower temperature to accomplish the opposite effect, namely, to effect covalent coupling of the carboxylic acid to the fibers and at the same time, maintain sufficient free carboxylic acid groups (i.e., carboxylic acid groups that are not bonded to the fiber) to impart the advantageous properties of absorbent capacity and bondability to the fibers, and absorbency and strength to fibrous compositions incorporating these fibers. In the context of the present invention, the polycarboxylic acid is optimally covalently coupled to the fiber through a single carboxylic acid group, forming a single ester bond between the fiber and the polycarboxylic acid. Reaction through a single carboxylic acid group allows the remaining carboxylic acid group or groups of the polycarboxylic acid to participate in interfiber interactions (e.g., hydrogen bonding) in fibrous compositions, thereby enhancing the strength of those compositions. Thus, although the invention described in the Herron patents and the present invention generally incorporate a polycarboxylic acid into cellulose fibers, because of the diverse treatments and goals, the resulting products are distinct. As noted above, the Herron patents describe utilizing a polycarboxylic acid as a crosslinking agent to form intrafiber ester crosslinks. In contrast, the present invention utilizes a polycarboxylic acid as a carboxylating agent to incorporate one or more carboxyl groups into the fiber to enhance the fibers' bondability.

Those knowledgeable in the area of polycarboxylic acids will recognize that the polycarboxylic acids useful in the present invention may be present on the fibers in a variety of forms including, for example, the free acid form, and salts thereof. It will be appreciated that all such forms are included within the scope of the invention. Furthermore, although the carboxylating agent has been described as a polycarboxylic acid, it will be appreciated that other carboxylating agents that include functional groups capable of providing a polycarboxylic acid, for example, an acid salt, an ester, or an acid anhydride, having the properties and characteristics described above are also carboxylating agents within the scope of this invention.

The carboxylating agents noted above can be used alone or in combination to provide the cellulose fibers of the present invention having carboxyl groups.

The carboxylated cellulose fibers have an effective amount of a polycarboxylic acid covalently coupled to the fibers through an ester bond. That is, polycarboxylic acid in an amount sufficient to provide an improvement in strength (e.g., tensile, sheet) in compositions (e.g., fibrous sheets, webs, mats) containing the cellulose fibers to which the polycarboxylic acid is covalently coupled, relative to conventional fibers lacking such carboxylated fibers. Generally, the cellulose fibers are treated with a sufficient amount of a polycarboxylic acid such that an effective amount of polycarboxylic acid is covalently coupled to the fibers.

The polycarboxylic acid is preferably present on the fibers in an amount from about 0.1 to about 10 percent by weight of the total weight of the fibers. More preferably, the polycarboxylic acid is present in an amount from about 0.2 to about 7 percent by weight of the total weight of the fibers, and in a particularly preferred embodiment, from about 0.4 to about 6 percent by weight of the total weight of the fibers. At less than about 0.1 percent by weight polycarboxylic acid, no significant absorbent or bondability enhancement is observed, and at greater than about 10 percent by weight, the maximum coupling capacity of the fibers is exceeded.

The carboxylating agent can be applied to the fibers for covalent coupling by any one of a number of methods known in the production of treated fibers. For example, the carboxylating agent can be contacted with the fibers as a fiber sheet is passed through a bath containing the carboxylating agent. Alternatively, other methods of applying the carboxylating agent, including fiber spraying, or spraying and pressing, or dipping and pressing with a carboxylating agent solution, are also within the scope of the invention.

Generally, the carboxylated cellulosic fibers of the present invention can be prepared by applying a carboxylating agent, as described above, to cellulose fibers, and then coupling or bonding the carboxylating agent to the fibers for a period of time and at a temperature sufficient to effect ester bond formation between the carboxylating agent and the fibers. In the context of the present invention, such ester bond formation between the carboxylating agent and fibers is not exhaustive ester bond formation as in fiber crosslinking. The temperature sufficient to effect ester bond formation is generally lower than the cure temperature of a typical crosslinking agent and will also vary depending upon the specific acid and moisture content of the fibers, among other factors. For an exemplary acid, succinic acid, the temperature sufficient to effect ester bond formation ranges from about 120° C. to about 160° C. The use of a catalyst to promote ester bond formation between the carboxylating agent and the cellulose fiber in the method is preferred and reduces the temperature required to effect ester bond formation. While catalysts can be used to effectively lower the bonding temperature of the carboxylating agent, in accordance with the present invention, the use of catalysts preferably does not result in exhaustive crosslinking of the carboxylating agent to the fibers. The effect of bonding temperature on the introduction of carboxylic acid groups and water retention value for fibers treated with succinic acid is summarized in Example 1, Table 1. It can be seen that the WRV maximum is at 130° C. to 140° C. and that at higher bonding temperatures the WRV decreases due to a higher proportion of crosslinking reactions.

As noted above, the carboxylated cellulosic fibers of the invention can also be prepared with the aid of a catalyst. In such a method, the catalyst is applied to the cellulose fibers in a manner analogous to application of the carboxylating agent to the fibers as described above. The catalyst may be applied to the fibers prior to, after, or at the same time that the carboxylating agent is applied to the fibers. Accordingly, the present invention provides a method of producing carboxylated cellulosic fibers that includes coupling the carboxylating agent to the fibers in the presence or absence of a catalyst.

Generally, the catalyst promotes ester bond formation between the carboxylating agent and the cellulose fibers and is effective in increasing bond formation (i.e., the number of bonds formed) at a given cure temperature. Suitable catalysts include any catalyst that increases the rate of bond formation between the carboxylating agent and cellulose fibers. Preferred catalysts include alkali metal salts of phosphorous containing acids such as alkali metal hypophosphites, alkali metal phosphites, alkali metal polyphosphonates, alkali metal phosphates, and alkali metal sulfonates. Particularly preferred catalysts include alkali metal polyphosphonates such as sodium hexametaphosphate, and alkali metal hypophosphites such as sodium hypophosphite. When a catalyst is used to promote bond formation, the catalyst is typically present in an amount in the range from about 5 to about 20 weight percent of the carboxylating agent. Preferably, the catalyst is present in about 10 percent by weight of the carboxylating agent. The effect of catalyst (1.5 to 3.0 percent by weight sodium hypophosphite at 140° C.) on the introduction of carboxylic acid groups and water retention value for fibers treated with succinic acid is summarized in Example 1, Table 2.

Cellulosic fibers are a basic component of the carboxylated fibers of the present invention. Although available from other sources, cellulosic fibers are derived primarily from wood pulp. Suitable wood pulp fibers for use with the invention can be obtained from well-known chemical processes, such as the kraft and sulfite processes, with or without subsequent bleaching. The pulp fibers may also be processed by thermomechanical, chemithermomechanical methods, or combinations thereof. The preferred pulp fiber is produced by chemical methods. Ground wood fibers, recycled or secondary wood pulp fibers, and bleached and unbleached wood pulp fibers can be used. Softwoods and hardwoods can be used. Details of the selection of wood pulp fibers are well-known to those skilled in the art. These fibers are commercially available from a number of companies, including Weyerhaeuser Company, the assignee of the present invention. For example, suitable cellulose fibers produced from southern pine that are usable with the present invention are available from Weyerhaeuser Company under the designations CF416, NF405, PL416, FR516, and NB416.

In general, the carboxylated cellulosic fibers of the present invention may be prepared by a system and apparatus as described in U.S. Pat. No. 5,447,977 to Young, Sr. et al., which is incorporated herein by reference in its entirety. Briefly, the fibers are prepared by a system and apparatus comprising a conveying device for transporting a mat of cellulose fibers through a fiber treatment zone; an applicator for applying a treatment substance such as a carboxylating agent to the fibers at the fiber treatment zone; a fiberizer for completely separating the individual cellulosic fibers comprising the mat to form a fiber output comprised of substantially unbroken and individualized cellulose fibers; and a dryer coupled to the fiberizer for flash evaporating residual moisture and for bonding the carboxylating agent to the fiber and to form dried, individualized carboxylated fibers.

As used herein, the term "mat" refers to any nonwoven sheet structure comprising cellulose fibers or other fibers that are not covalently bound together. As noted above, fibers include those obtained from wood pulp or other sources including cotton rag, hemp, grasses, cane, husks, cornstalks, or other suitable sources of cellulose fibers that can be laid into a sheet. The mat of cellulose fibers is preferably in an extended sheet form, and can be one of a number of baled sheets of discrete size or can be a continuous roll.

Each mat of cellulose fibers is transported by a conveying device, for example, a conveyor belt or a series of driven rollers. The conveying device carries the mats through the fiber treatment zone.

At the fiber treatment zone the carboxylating agent acid is applied to the cellulose fibers. The carboxylating agent is preferably applied to one or both surfaces of the mat using any one of a variety of methods known in the art including spraying, rolling, or dipping. Once the materials have been applied to the mat, the materials can be uniformly distributed through the mat, for example, by passing the mat through a pair of rollers.

After the fibers have been treated with the carboxylating agent, the impregnated mat can be fiberized by feeding the mat through a hammermill. The hammermill serves to separate the mat into its component individual cellulose fibers, which are then blown into a dryer.

The dryer performs two sequential functions; first removing residual moisture from the fibers, and second bonding the carboxylating agent in accordance with the present invention. In one embodiment, the dryer comprises a first drying zone for receiving the fibers and for removing residual moisture from the fibers via a flash-drying method, and a second drying zone for effecting the carboxylating agent-to-fiber bond. Alternatively, in another embodiment, the treated fibers are blown through a flash-dryer to remove residual moisture, and then transferred to an oven where the treated fibers are subsequently formed in accordance with the present invention.

A representative method for forming the carboxylated fibers of the invention is described in Example 1. The incorporation of carboxylic acid groups and water retention values for representative carboxylated fibers prepared by treating with succinic acid are presented in Example 1, Tables 1–3. As noted above, the present invention provides carboxylated fibers having a water retention value about equal to, preferably greater than, the water retention value of fibers from which the carboxylated fibers are formed. In general, the carboxylated fibers of the invention have a water retention value greater than about 1.0 g/g. Generally, increasing carboxylic acid group incorporation into the fibers increases the fibers' water retention value. However, at higher bonding temperatures, increased carboxylic acid group incorporation can be accompanied by increased crosslinking, which results in a decrease in the fibers' water retention value. Increased incorporation of carboxylic acid groups into the fibers also increases the fibers' bondability. In a preferred method, fibers are treated with a carboxylating agent (about 6 percent by weight based on total weight of fibers) at pH of from about 2 to about 4 in the presence of a catalyst (about 3 percent by weight based on total weight of fibers) and then heated at about 140° C. to effect carboxylating agent-to-fiber bonding.

The carboxylated cellulosic fibers of the present invention are preferably combined with a cationic additive to form fibrous sheets and absorbent products that exhibit enhanced wet and/or dry strength. The advantageous strength properties imparted to fibrous compositions that include carboxylated fibers and a cationic additive are due, at least in part, to the relatively strong attraction and association of the cationic additive to the carboxylated fibers, which are anionic in nature.

Exemplary cationic additives include, for example, wet strength resins and cationic starches that are useful in paper manufacturing. Suitable wet strength resins include polyamide epichlorohydrin, polyethyleneimine, and polyacrylamide wet strength resins. Polyamide epichlorohydrin resin is commercially available, for example, under the designation Kymene® 557LX and 557H (Hercules, Inc., Wilmington, Del.). Polyacrylamide resin is described, for example, in U.S. Pat. No. 3,556,932 issued Jan. 19, 1971 to Coscia et al., and another is commercially available under the designation Parez™ 631 NC (American Cyanamid Co., Stamford, Conn.). Cationic starches are commercially available from a variety of sources including National Starch and Chemical Corp., Bridgewater, N.J. A preferred cationic starch is available from Western Polymer Co., Moses Lake, Wash. under the designation Wescat EF. A general discussion on wet strength resins utilized in the paper field, and generally applicable in the present invention, can be found in TAPPI Monograph Series No. 29, "Wet Strength in Paper and Paperboard", Technical Association of the Pulp and Paper Industry (New York, 1965), expressly incorporated herein in its entirety.

Generally, the wet strength agent is present in the composition in an amount from about 0.01 to about 10 weight percent, and preferably from about 0.1 to about 5 weight percent, based on the total weight of the composite. In one preferred embodiment, the wet strength agent useful in forming the composite of the present invention is a polyamide epichlorohydrin resin commercially available from Hercules, Inc. under the designation Kymene® 557H. The wet and dry tensile strengths of an absorbent composite formed in accordance with the present invention will generally increase with an increase in the amount of wet strength agent.

Carboxylated fibers that further include a cationic additive can also be prepared as generally described above. Briefly, such fibers can be prepared by applying a cationic additive to the fibrous mat, for example, at the fiber treatment zone. The cationic additive can be applied to the fibrous mat either before, during, or after application of the carboxylating agent. The resulting treated fibers can then be fiberized and heated to effect drying and bonding of the carboxylating agent to the fibers to provide individualized carboxylated fibers that further include a cationic additive.

Alternatively, a fibrous mat or web can be formed by applying a carboxylating agent and, optionally, a cationic additive, to the fibrous mat and, rather than fiberizing the mat to form individualized fibers, the treated fibrous mat can be heated to effect drying and bonding of the carboxylating agent to the fibers to provide a mat of carboxylated fibers. Such a mat is particularly useful for transporting carboxylated fibers to subsequent destinations where the mat can then be fiberized to provide individual fibers that can be further combined with other fibers and materials as desired to provide various absorbent products. The carboxylated fibrous mat further including a cationic additive can also be subsequently reslurried and combined with other fibers and materials to provide a variety of fibrous products.

The carboxylated cellulosic fibers formed as described above are fibers that have been modified to include carboxyl groups. The modified fibers' carboxyl groups are available to form hydrogen bonds with, for example, other fibers including other carboxylated fibers. Therefore, the carboxylated fibers formed in accordance with the present invention, optionally including a cationic additive, can be advantageously combined with other fibers and materials to provide a fibrous composite having a variety of properties including advantageous strength properties imparted to the composite by the carboxylated fibers. The carboxylated fibers of the invention, optionally including a cationic additive, can be combined with other fibers including carboxylated fibers such as carboxymethylcellulose and carboxyethylcellulose, crosslinked cellulosic fibers, untreated cellulosic fibers, thermomechanical fibers, chemithermomechanical (CTMP) fibers, cellulose acetate fibers, polyester fibers, and thermobondable fibers.

Figure 2:
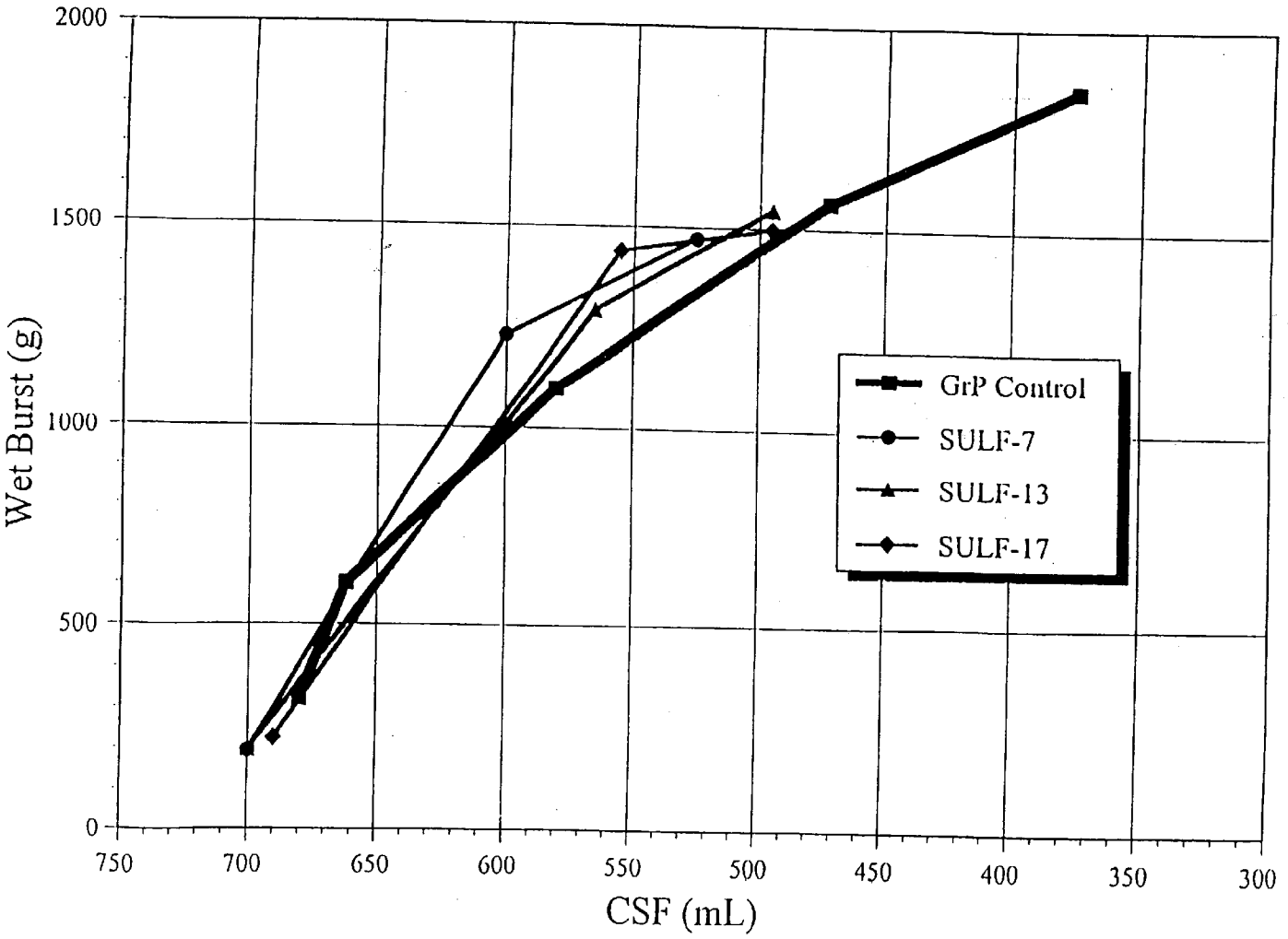
FIG. 2 is a graph showing wet burst strength of handsheets prepared from refined soft wood pulp (various CSF) modified with sulfosuccinic acid (SULF) and 2 percent Kymene® 557H; GrP control refers to a handsheet prepared from unmodified fibers; SULF-7, SULF-13, and SULF-17 refer to handsheets prepared from sulfosuccinic acid-modified fibers having 7, 13, and 17 meq carboxyl groups/100 g fiber, respectively.
Figure 3:
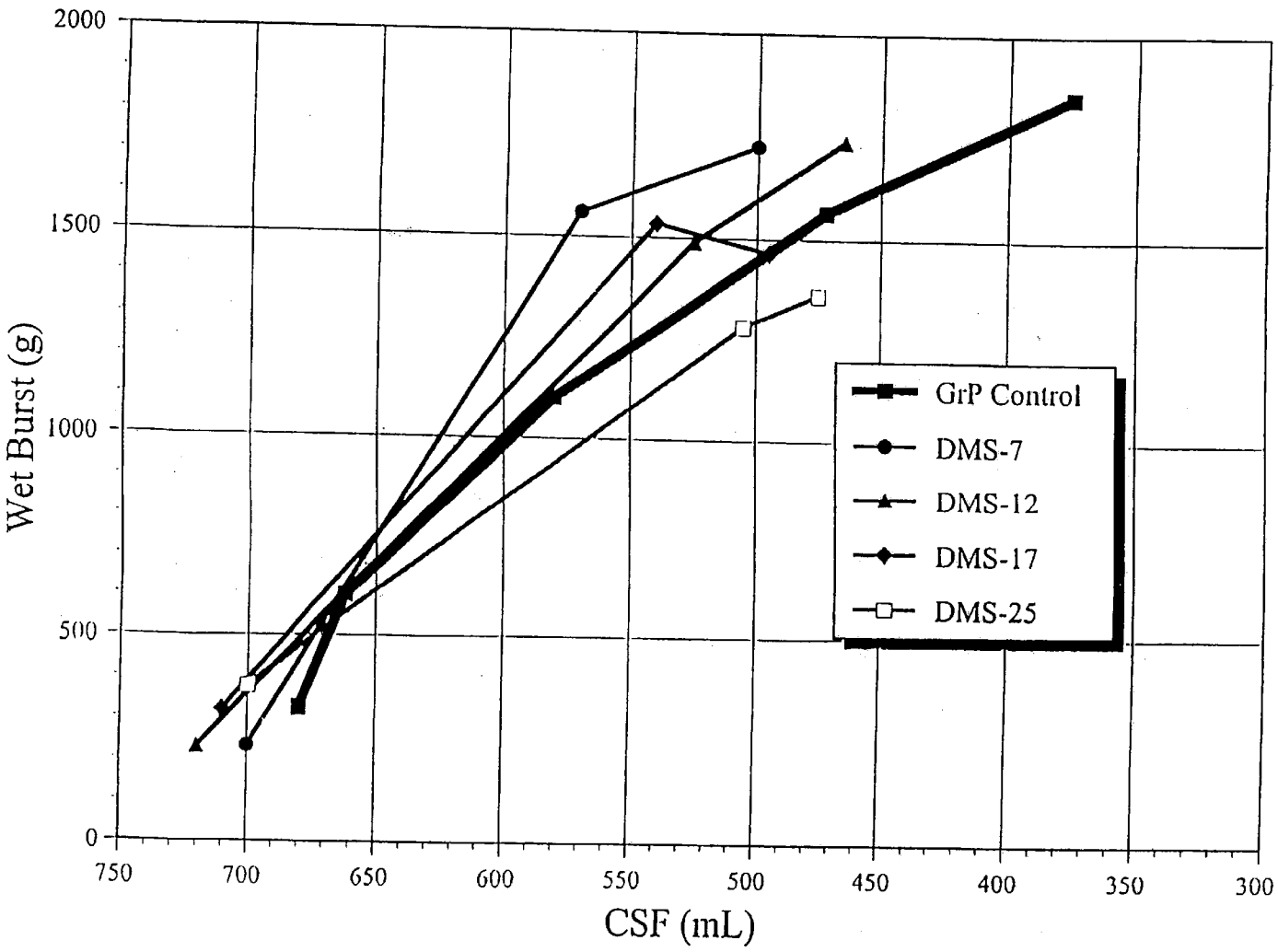
FIG. 3 is a graph showing wet burst strength of handsheets prepared from refined soft wood pulp (various CSF) modified with 2,2-dimethylsuccinic acid (DMS) and 2 percent Kymene® 557H; GrP control refers to a handsheet prepared from unmodified fibers; DMS-7, DMS-12, DMS-17, and DMS-25 refer to handsheets prepared from 2,2-dimethylsuccinic acid-modified fibers having 7, 12, 17, and 25 meq carboxyl groups/100 g fiber, respectively.

A representative procedure for forming fibrous webs that include the carboxylated fibers of the invention is described in Example 2. Generally, fibrous webs formed from carboxylated fibers and a wet strength agent have increased wet strength compared to fibrous webs that do not contain carboxylated fibers. The wet burst strength of handsheets formed from carboxylated fibers and a representative wet strength agent was found to be significantly greater than for handsheets prepared from the corresponding untreated fibers. FIGS. 1–3 illustrate the increase in wet burst strength for handsheets formed from fibers treated with 2 percent Kymene® 557H and various amounts of succinic acid, sulfosuccinic acid, and 2,2-dimethylsuccinic acid, respectively.

Figure 4:
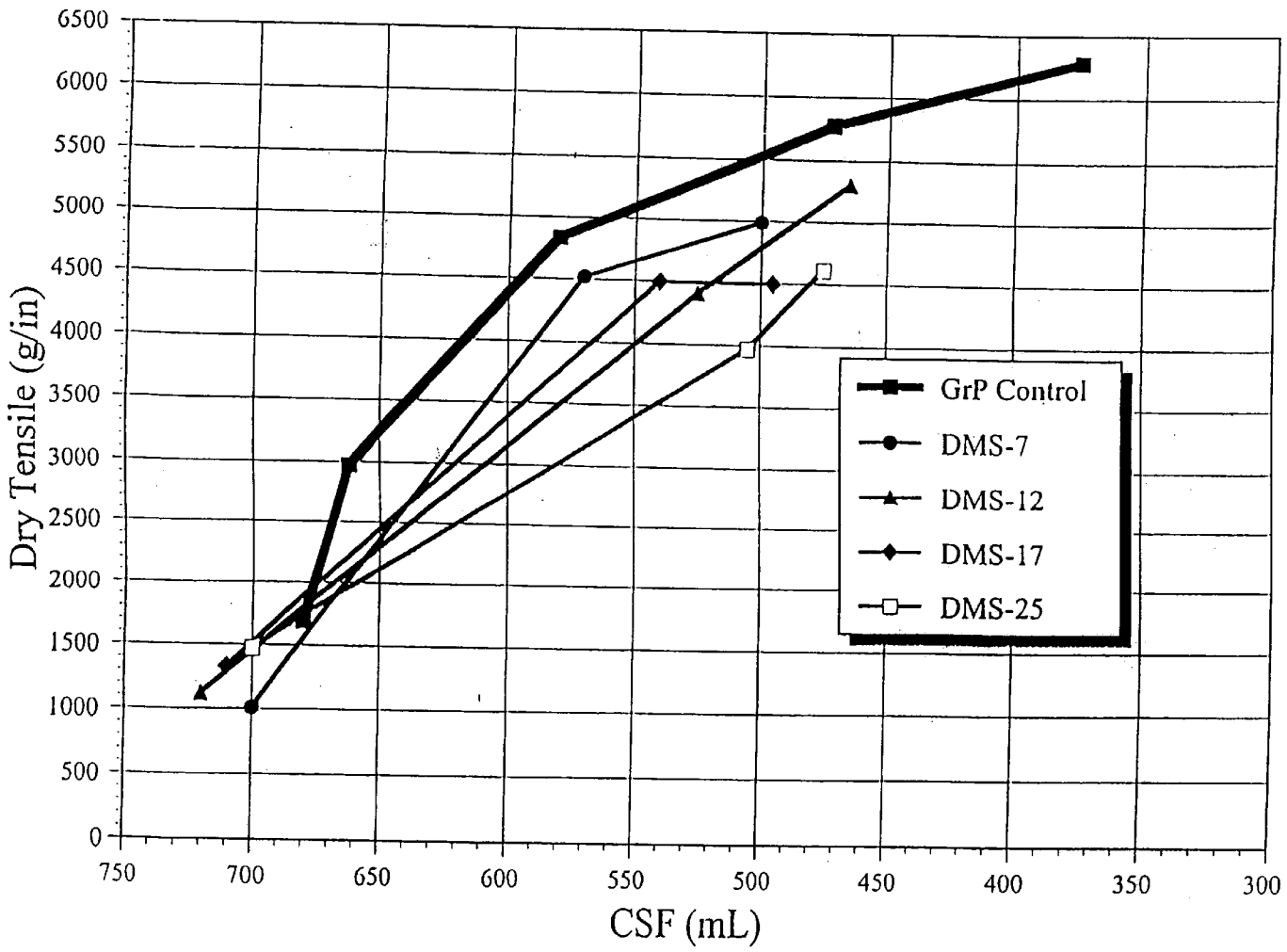
FIG. 4 is a graph showing dry tensile strength of handsheets modified with 2,2-dimethylsuccinic acid (DMS) and 2 percent Kymene® 557H at various levels of refinement (CSF); GrP control refers to a handsheet prepared from unmodified fibers; DMS-7, DMS-12, DMS-17, and DMS-25 refer to handsheets prepared from 2,2-dimethylsuccinic acid-modified fibers having 7, 12, 17, and 25 meq carboxyl groups/100 g fiber, respectively.
Figure 5:
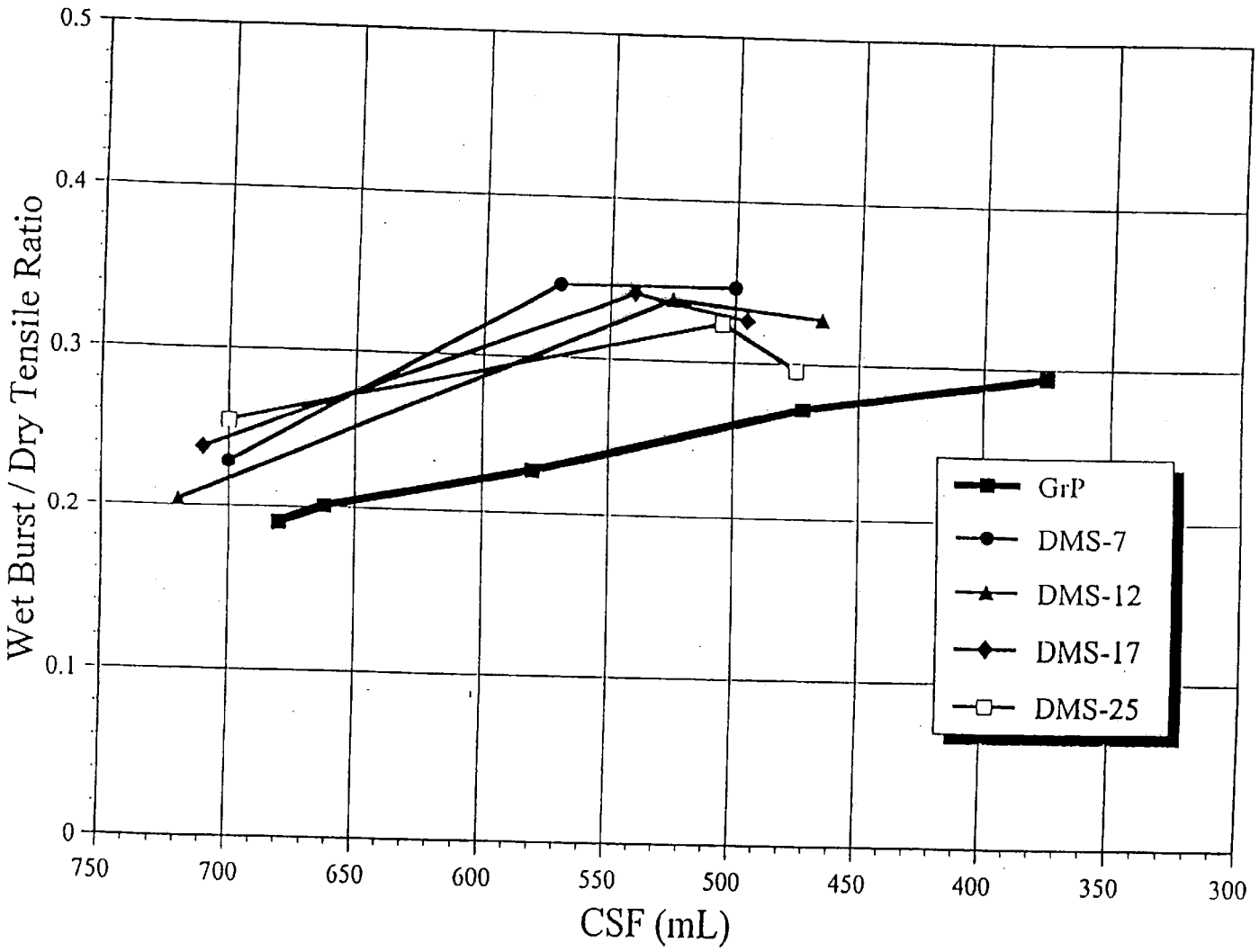
FIG. 5 is a graph showing the ratio of wet burst to dry tensile strength for handsheets modified with 2,2-dimethylsuccinic (DMS) and 2 percent Kymene® 557H at various levels of refinement (CSF); GrP control refers to a handsheet prepared from unmodified fibers; DMS-7, DMS-12, DMS-17, and DMS-25 refer to handsheets prepared from 2,2-dimethylsuccinic acid-modified fibers having 7, 12, 17, and 25 meq carboxyl groups/100 g fiber, respectively.

Fibrous webs formed from the carboxylated fibers of the invention also have reduced dry strength compared to webs formed from untreated fibers. Reduced web dry strength corresponds to enhanced web softness. Thus, incorporating carboxylated fibers into a fibrous web provides a web with enhanced softness compared to a corresponding web prepared from untreated fibers. The dry tensile strength of representative handsheets formed from carboxylated (i.e., 2,2-dimethylsuccinic acid) fibers and a wet strength agent (i.e., 2 percent Kymene®) and a corresponding handsheet formed from untreated fibers is illustrated in FIG. 4. Referring to FIG. 4, the dry tensile strength of the handsheets formed from the carboxylated fibers is significantly reduced compared to the web formed from untreated fibers. The ratio of wet burst strength to dry tensile strength for handsheets prepared from carboxylated fibers and containing a wet strength agent (i.e., 2 percent Kymene®) is illustrated in FIG. 5. Referring to FIG. 5, the high wet/dry strength ratio for the handsheets formed in accordance with the present invention compared to handsheets formed from untreated fibers indicates that the handsheets that include carboxylated fibers possess advantageous wet strength in addition to softness.

Carboxylated cellulosic fibers provide advantageous absorbent and strength properties to fibrous composites that include such fibers. By virtue of bonding the carboxylating agent to the fiber, anionic sites and hydrogen bonding sites are added to the fiber. Generally, the carboxyl groups enhance fiber swelling, which provides for advantageous absorbent properties. In addition, the carboxyl groups provide for strong attraction and association to cationic additives such as wet strength agents that increase the wet strength and integrity of absorbent products that include these fibers.

The carboxylated fibers of the invention can be formed into sheets or mats having high absorbent capacity, bulk, resilience, and increased tensile strength. For example, these fibers may be combined with other fibers such as crosslinked and CTMP pulp fibers. The resulting sheets can be incorporated into a variety of absorbent products including, for example, tissue sheets, paper toweling, disposable diapers, adult incontinence products, sanitary napkins, and feminine care products. The carboxylated fibers of the present invention are particularly useful in absorbent products requiring high wet burst strength.

The following examples illustrate the practice of the present invention, and are not intended to be limiting thereof.

EXAMPLES

Example 1

A Representative Method for Preparing Carboxylated Cellulosic Fibers

The carboxylated cellulosic fibers of the present invention and products containing these fibers can be prepared by a system and apparatus as generally described in U.S. Pat. No. 5,447,977 to Young, Sr. et al., which is incorporated herein by reference in its entirety.

In this example, the preparation of carboxylated cellulosic fibers is described. This example demonstrates that a polycarboxylic acid can be bonded to cellulosic fibers to provide fibers having enhanced absorbent capacity and bondability.

In the process, a fiber sheet composed of individual cellulose fibers (available under the designation NB416 from Weyerhaeuser Co., New Bern, N.C.) is treated with succinic acid at varying bonding temperatures according to the following procedure.

Briefly, a fiber sheet is fed from a roll through a constantly replenished bath of an aqueous solution containing succinic acid adjusted to concentrations to achieve the desired level of succinic acid (e.g., about 0.25 to about 10 percent by weight of the total composition) and sodium hypophosphite (at a concentration approximately one-half that of succinic acid). The treated fiber sheet is then moved through a roller nip set to remove sufficient solution to provide a fiber sheet having a pulp solids content of about 50 percent. After passing through the roll nip, the wet fibrous sheet is air dried. The bonding of the polycarboxylic acid to the individualized fibers is completed by placing the fibrous sheet in a laboratory oven and heating at about 140° C. for 20 minutes.

The effect of bonding temperature on the level of carboxylic acid group incorporation into the fibers and the water retention value of the fibers is summarized in Table 1. Fibers were treated with succinic acid (6 percent by weight based on the total weight of fibers) and sodium hypophosphite (3 percent by weight based on the total weight of fibers) and heated at the indicated temperature for 20 minutes. Water retention value (WRV) was determined by TAPPI Method UM 256, and the level of carboxylic acid group incorporation was determined by TAPPI Method T237 OM-88. In Table 1, Control 120 and Control 160 refer to control fibers that were heated to the respective bonding temperature without succinic acid treatment. Yield (%) refers to the percent conversion of succinic acid.

TABLE 1

The Effect of Temperature on Succinic Acid Esterification of Cellulose Fibers

| Temp. ° C. | Carboxyl Level (meq/100 g) | WRV (g/g) | Yield (%) |
|---|---|---|---|
| 120 | 12 | 1.22 | 25 |
| 130 | 23 | 1.31 | 46 |
| 140 | 26 | 1.31 | 53 |
| 150 | 30 | 1.29 | 60 |
| 160 | 34 | 0.96 | 67 |
| Control 120 | 4 | 1.12 | — |
| Control 160 | 4 | 1.00 | — |

The maximum WRV, and thus the maximum swelling of the fibers, is obtained at bonding temperatures of 130° to 140° C. Despite the fact that more carboxyl groups are incorporated at higher temperatures, which would normally increase WRV and swelling, the WRV actually decreases due to the occurrence of undesirable crosslinking at temperatures above 140° C. The temperatures in Table 1 represent a 20-minute bonding time. As would be expected with any chemical reaction, the optimum temperature will increase with shorter bonding times, and decrease with longer bonding times.

The effect of a catalyst on the bonding of the carboxylating agent to the fibers is summarized in Table 2. Fibers were treated with succinic acid (6 percent by weight based on total weight of fibers) and the indicated amount of sodium hypophosphite and heated at 140° C. for 20 minutes.

TABLE 2

The Effect of Catalyst on Succinic Acid Esterification of Cellulose Fibers

| Catalyst % | Carboxyl Level (meq/100 g) | WRV (g/g) | Yield (%) |
|---|---|---|---|
| 0 | 8 | 0.94 | 16 |
| 1.5 | 30 | 1.30 | 60 |
| 3.0 | 34 | 1.36 | 68 |

With no catalyst present, only a slight amount of esterification occurs, and the WRV of the fibers actually decreases instead of increasing. The result suggests that substantial crosslinking is occurring. With catalyst present in an effective amount, significantly more esterification occurs and the WRV of the fibers increases substantially.

The effect of pH on the bonding of the carboxylating agent to the fibers is summarized in Table 3. Fibers were treated with succinic acid (6 percent by weight based on the total weight of fibers) and sodium hypophosphite (3 percent by weight based on the total weight of fibers) and heated at 140° C. for 20 minutes.

TABLE 3

The Effect of pH on Succinic Acid Esterification of Cellulose Fibers

| pH | Carboxyl Level (meq/100 g) | WRV (g/g) | Yield (%) |
|---|---|---|---|
| 4.5 | 11 | 1.01 | 21 |
| 4.0 | 16 | 1.28 | 34 |
| 3.5 | 21 | 1.34 | 42 |
| 3.0 | 24 | 1.28 | 48 |

TABLE 3-continued

The Effect of pH on Succinic Acid Esterification of Cellulose Fibers

| pH | Carboxyl Level (meq/100 g) | WRV (g/g) | Yield (%) |
|---|---|---|---|
| 2.5 | 26 | 1.29 | 53 |
| 2.0 | 28 | 1.29 | 56 |

The effect of increasing the pH of the succinic acid/sodium hypophosphite solution from 2.0 up to 4.5 is to decrease the level of esterification proportionately. However, the WRV and fiber swelling reach a maximum at pH 3.5. The results suggest that at pHs lower than 3.5, a higher degree of crosslinking occurs compared to pH 3.5 and above.

Example 2

A Representative Method for Preparing Handsheets Containing Carboxylated Cellulosic Fibers In this example, the preparation of handsheets from representative carboxylated cellulosic fibers is described.

About 30.5 g of GrP pulp was refined in a PFI Refiner to the desired freeness as measured by the Canadian Standard Freeness (CSF) test. GrP (Grand Prairie Softwood) refers to a Canadian bleached kraft wood pulp made from a mixed furnish predominantly of white spruce, lodgepole pine, and balsam fir, with the major component being spruce. The refiner was designated No. 138 manufactured by P. F. I. M ølle, Hamjem, Oslo, Norway. The freeness tester is manufactured by Robert Mitchell Company, Ltd., Ste. Laurent, Quebec. The refined pulp was then placed in a disintegrator for 10,000 revolutions to obtain a uniform slurry. The pulp slurry was then diluted to 10 L and consistency determined. The disintegrator is a British Pulp Evaluation Apparatus, manufactured by Mavis Engineering, Ltd., London, England. All three machines are also available from Testing Machines Inc., Amityville, N.Y.

The cationic wet strength additive was a water-soluble polyamide epichlorohydrin (PAE) reaction product, Kymene® 557H (Hercules, Inc., Wilmington Del.). Kymene® 557H is supplied as a 12.5% solids aqueous solution. For use, Kymene® as received was diluted to a 1% solids solution.

Handsheets were formed in a conventional manner in a sheet mold that produced sheets 152 mm (6 in) in diameter. White water from the sheet mold was recycled as dilution water for subsequent sheets to better simulate commercial operating conditions. The first seven sheets made were discarded to allow white water fines to build up to an equilibrium level. Following that, the eighth sheet was used to check sheet weight and adjust amount of stock added in order to produce the desired 1.2 g (oven dry weight) sheets. Then 10 additional sheets were made for testing.

Following drying, the sheets were oriented on edge in a wire rack and placed in an oven at 100° C. for one hour to allow good curing of any wet strength resin. A number of samples were made using 100 percent modified carboxylated pulps as well as blends of these pulps with unmodified pulp. For most conditions, similar handsheet samples of the carboxylated pulps were made for comparison.

Physical properties of the various modified materials and blends are best understood by referring to FIGS. 1–5. Wet burst tests were conducted using a Thwing-Albert Model 1300-177 Burst Tester (Thwing-Albert Instrument Co., Philadelphia, Pa.). Dry tensile tests were performed according to TAPPI Method 494 Tensile Breaking Properties of Paper and Paperboard.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for increasing the wet strength of a fibrous sheet, comprising:

forming a fibrous slurry, wherein the slurry comprises individualized carboxylated cellulosic fibers, the fibers comprising cellulosic fibers covalently coupled to a carboxylating agent through an ester bond, wherein the carboxylating agent provides a carboxyl group to the fibers, and wherein the carboxylating agent is a polycarboxylic acid having one carboxyl group separated from a second carboxyl group by either two or three atoms, wherein the carboxylated fibers have a water retention value greater than or equal to the water retention value of the fibers from which the carboxylated fibers are formed;

depositing the fibrous slurry on a foraminous support;

dewatering the deposited slurry to provide a wet composite; and drying the wet composite to provide a fibrous sheet having a wet strength greater than a fibrous sheet formed from a fibrous slurry lacking carboxylated cellulosic fibers.

2. The method of claim 1 wherein the polycarboxylic acid is selected from the group consisting of a dicarboxylic acid, an organic acid having three or more carboxyl groups, a polymeric polycarboxylic acid, and mixtures thereof.

3. The method of claim 1 wherein the fibrous slurry further comprises a catalyst.

4. The method of claim 1 wherein the fibrous slurry further comprises a cationic additive.

5. The method of claim 1 wherein the fibrous slurry comprises fibers selected from the group consisting of carboxymethylated fibers, carboxyethylated fibers, crosslinked fibers, untreated cellulosic fibers, thermomechanical fibers, chemithermomechanical fibers, cellulose acetate fibers, polyester fibers, thermobondable fibers, and mixtures thereof.

* * * * *